US006875955B2

(12) United States Patent
Yoshida et al.

(10) Patent No.: US 6,875,955 B2
(45) Date of Patent: Apr. 5, 2005

(54) THERMAL ACTIVATION DEVICE FOR HEAT-SENSITIVE SELF-ADHESIVE SHEET AND A PRINTER ASSEMBLY

(75) Inventors: Shinichi Yoshida, Chiba (JP); Norimitsu Sambongi, Chiba (JP); Yoshinori Sato, Chiba (JP); Minoru Hoshino, Chiba (JP)

(73) Assignee: SII P & S Inc., Chiba (JP)

( * ) Notice: Subject to any disclaimer, the term of this patent is extended or adjusted under 35 U.S.C. 154(b) by 0 days.

(21) Appl. No.: 10/607,299

(22) Filed: Jun. 26, 2003

(65) Prior Publication Data

US 2004/0045953 A1 Mar. 11, 2004

(30) Foreign Application Priority Data

Jul. 17, 2002 (JP) ..... 2002-208556

(51) Int. Cl.[7] ..... H05B 1/00
(52) U.S. Cl. ..... 219/216; 219/486; 219/488
(58) Field of Search ..... 219/216, 482, 219/483, 486, 488

(56) References Cited

U.S. PATENT DOCUMENTS 5,961,227 A * 10/1999 Kurachi ..... 400/120.09

FOREIGN PATENT DOCUMENTS

| | | | |
|---|---|---|---|
| EP | 0899113 | 3/1999 | |
| EP | 1052177 | 11/2000 | |
| EP | 1193284 | 4/2002 | |
| WO | WO 93/24302 | * 12/1993 | ..... B29C/65/20 |

OTHER PUBLICATIONS

Patent Abstracts of Japan, vol. 2000, No. 02, Feb. 29, 2000, JP 11 311945 A (Teraoka Seiko Co Ltd), Nov. 9, 1999.

* cited by examiner

*Primary Examiner*—Robin O. Evans
*Assistant Examiner*—Vinod Patel
(74) *Attorney, Agent, or Firm*—Adams & Wilks

(57) ABSTRACT

A thermal activation device has a thermal head having heat generating elements for thermally activating a heat-sensitive adhesive layer of a heat-sensitive self-adhesive sheet. The heat-sensitive self-adhesive sheet has a sheet-like substrate having a printable surface on a first side thereof and the heat-sensitive adhesive layer on a second side thereof. An energy control device controls the thermal head by applying one or more voltage pulses to the heat generating elements for energizing the heat generating elements to thereby thermally activate an area of the heat-sensitive self-adhesive layer in one step. When a series of the voltage pulses are applied to the heat generating elements, the energy control device selectively switches between the heat generating elements to be energized by the voltage pulses each time one of the voltage pulses is applied.

20 Claims, 8 Drawing Sheets

THERMAL ACTIVATION DEVICE FOR HEAT-SENSITIVE SELF-ADHESIVE SHEET AND A PRINTER ASSEMBLY

BACKGROUND OF THE INVENTION

1. Field of the Invention

The present invention relates to a thermal activation device for a heat-sensitive self-adhesive sheet and to a printer assembly employing the thermal activation device, the heat-sensitive self-adhesive sheet having a heat-sensitive adhesive layer formed on one side of a sheet-like substrate thereof and used as an affixing label, for example, the heat-sensitive adhesive layer being normally non-adhesive but developing adhesiveness when heated. Particularly, the invention relates to a technique advantageously applied to energy control of a thermal head used for thermally activating the heat-sensitive adhesive layer.

2. Description of the Related Art

Recently, many labels affixed to products for indication of bar codes, prices or the like are stored in a state where the pressure-sensitive adhesive layer is provided on a back side of a recording surface (printable surface) and has a liner (separator) temporarily affixed thereon. Unfortunately, the labels of this type require the liner to be removed from the pressure-sensitive adhesive layer when used, thus always producing waste.

As a system negating the need for the liner, there has been developed a heat-sensitive self-adhesive label having a heat-sensitive adhesive layer on a back side of a label-shaped substrate thereof, the heat-sensitive adhesive layer being normally non-adhesive but developing adhesiveness when heated. On the other hand, a thermal activation device for heating the heat-sensitive adhesive layer of the heat-sensitive self-adhesive label is now under development. For example, there is known a thermal activation device employing a thermal head as heating means.

The thermal head normally includes an array of heat generating elements (resistances) which are energized with voltage thereby generating heat. In the thermal activation device employing this thermal head, the array of heat generating elements are energized in unison by applying a predetermined voltage pulse simultaneously. The heat-sensitive self-adhesive label is thermally activated on a per-line basis as advanced in a direction orthogonal to the array of the heat generating elements, whereby the heat-sensitive self-adhesive label is caused to develop adhesive force on the overall surface thereof.

In a case where the heat-sensitive self-adhesive label is thermally activated by means of such a thermal activation device, importance is attached to the development of the adhesive force of a magnitude -to prevent easy peel-off of the heat-sensitive self-adhesive label from a support material (an article affixed with the label). Hence, it is a common practice to carry out the thermal activation in a manner that the overall adhesive surface of the heat-sensitive self-adhesive label may have a great adhesive force (of a magnitude that once affixed, the label can never be peeled off or will be broken if it is forcibly peeled).

In this case, however, such a great adhesive force to prevent the peel-off of the heat-sensitive self-adhesive label from the support material also leads to a disadvantage that when the affixed label is not needed any more, the label cannot be peeled off easily. For instance, labels for use on baggage to be checked before getting on board airplanes may desirably be peelable because these labels are usually unnecessary after the baggage is received.

It may be contemplated to control the energy for thermally activating the head-sensitive self-adhesive label, which is used for such a purpose, thereby decreasing the developed adhesive force to a point. In the case of the thermal activation device employing the thermal head, for example, the applied energy is controllable by way of the magnitude of a voltage pulse or the pulse width (voltage application time).

Unfortunately, there are some types of heat-sensitive adhesives which are difficult to control the adhesive force developed therein. As to an adhesive having a characteristic curve indicated by a solid line T1 in FIG. 9, for example, an adhesive force of at least F1 (the great adhesive force) can be readily attained by applying an energy of at least E1. However, the development of an adhesive force in the range of at least F2 to less than F1 (a small adhesive force) requires the magnitude of voltage pulses or pulse width to be so controlled as to limit the applied energy in the range of E1 to E2. Besides, a relation between the energy applied to the adhesive and the adhesive force (see, for example, T1, T2 in FIG. 9) depends upon ambient temperatures and hence, the control of the magnitude of pulse voltage or pulse width may be complicated at some ambient temperatures where the heat-sensitive self-adhesive label is used.

An alternative technique for controlling the adhesive force has been proposed wherein the heat-sensitive self-adhesive label is thermally activated at local places thereof for locally developing the great adhesive force rather than developing the adhesive force on the overall surface thereof. That is, a ratio between an area of a portion having the great adhesive force and the total area of the label is controlled thereby adjusting the degree of adhesive force on the basis of the whole area of the label (JP-A-2000-48139).

According to the above technique, however, there exists a portion having no adhesive force at all, which leads to the following problem. In a case where the portion without the adhesive force is located near an end of a label, the label is prone to be peeled so easily that the label affixed to a baggage is likely to be lost unless the baggage is handled with care. Thus, the technique is not practicable. In a case where the thermal activation is focused on circumferential edges (frame form) of a label, an area without the adhesive force occupies a central part of the label in order to decrease the adhesive force on the basis of the overall label surface and hence, the central part of the label is more susceptible to air invasion. The invaded air lifts up the label from the support material, resulting in a low-quality appearance of the label. In addition, it is a cumbersome task to produce a thermal activation pattern for indicating what area of the heat-sensitive self-adhesive sheet is to be thermally activated and what area thereof is to be left un-activated.

SUMMARY OF THE INVENTION

It is an object of the invention to provide a thermal activation device and a printer assembly employing the same, the thermal activation device adapted for thermal activation based on any of various patterns according to the application of the heat-sensitive self-adhesive sheet and capable of developing an adhesive force of at least a predetermined magnitude on the overall surface of the heat-sensitive self-adhesive sheet.

In accordance with the invention accomplished for achieving the above object, a thermal activation device for heat-sensitive self-adhesive sheet at least comprises: a thermal head which serves as thermally-activating heating means for thermally activating a heat-sensitive adhesive layer of a heat-sensitive self-adhesive sheet including a sheet-like substrate having a printable surface on one side thereof and the heat-sensitive adhesive layer on the other side thereof and which includes an array of heat generating elements individually controllably energized; and energy control means for applying one or more shots of voltage pulse to the plural heat generating elements for energization thereby thermally activating an area of the heat-sensitive self-adhesive sheet that can be thermally activated by the thermal head in one step, and is characterized in that in a case where plural shots of voltage pulses are applied to the heat generating elements of the thermal head for thermally activating the heat-sensitive self-adhesive sheet, the energy control means can selectively change a heat generating element(s) to be energized by the voltage pulse each time the voltage pulse is applied.

Thus, the thermal activation may be performed in a manner to develop the adhesive force on the heat-sensitive self-adhesive sheet in any of various patterns so that the adhesive force or adhesive pattern of the sheet is freely controlled according to the use of the sheet. It is also possible to develop different degrees of adhesive force on adjoining dot regions and hence, the adhesive forces in gradations can be developed.

In a mode, the thermal activation device for heat-sensitive self-adhesive sheet is characterized in that the energy control means can select any of dot regions of the area that can be thermally activated by the thermal head in one step, and applies thereto either a first energy or a second energy higher than the first energy. Specifically, it is ensured that all the dot regions in the area to be thermally activated by the thermal head in one step are thermally activated to develop at least a small adhesive force.

In a case where the sheet is to be used on a support material which may require the affixed sheet -to be removed afterwards, for example, the thermal activation may be performed in a manner to develop the small adhesive force on the most of the area of the sheet and to develop the great adhesive force on a particularly important portion, such as circumferential edges (frame form) of the sheet. Accordingly, the heat-sensitive self-adhesive label thus thermally activated is readily peeled off while retaining a required adhesive force. Furthermore, the heat-sensitive self-adhesive sheet is affixed to the support material on its overall face, so that the air invasion into clearance between the sheet and the support material is eliminated. Thus, the appearance quality is not degraded.

Conversely, in a case where the sheet needs not be peelable, the thermal activation device can impart a required amount of adhesive force to the sheet as a whole instead of developing the great adhesive force on the overall surface of the sheet. Thus, the device requires less energy for thermal activation, contributing to power savings.

It is noted here that the great adhesive force means an adhesive force of a magnitude that once affixed, the sheet can never be peeled of f or will be broken if it is forcibly peeled. On the other hand, the small adhesive force means a force of a magnitude that the sheet is peeled off without damaging a surface of the support material (such as card board) nor leaving an adhesive mass (paste mass) thereon. In numerical expression, the great adhesive force is typically in the range of 1000 to 2000 gf/40 mm-width whereas the small adhesive force is typically in the range of 800 gf/40 mm-width or less.

In a mode, the thermal activation device for heat-sensitive self-adhesive sheet is characterized in that the energy control means comprises: application-condition defining means for defining the magnitude of voltage pulse to be applied, the pulse width or the number of application times; and heat-generating-element setting means for selecting a heat generating element(s) to be energized each time the voltage pulse is applied. Specifically, when a user specifies a desired adhesive force or type of heat-sensitive self-adhesive sheet to be used, the application-condition defining means automatically defines the pulse voltage, pulse width and number of application times while the heat-generating-element setting means automatically selects a heat generating element (s) to be energized.

This facilitates the development of a desired adhesive force of the heat-sensitive self-adhesive sheet through the thermal activation of the sheet.

In a mode, the thermal activation device for heat-sensitive self-adhesive sheet further comprises storage means for storing information on a thermal activation pattern for thermally activating the heat-sensitive self-adhesive sheet, and is characterized in that the application-condition defining means and the heat-generating-element setting means respectively defines the application conditions and sets the heat generating element(s) to be energized according to the thermal activation pattern. This further facilitates the thermal activation of the heat-sensitive self-adhesive sheet based on a desired pattern.

In a mode, the thermal activation device for heat-sensitive self-adhesive sheet further comprises ambient-temperature measuring means for measuring temperature in the vicinity of place where the heat-sensitive self-adhesive sheet is thermally activated by the thermally-activating heating means, and is characterized in that the application-condition defining means defines the application conditions based on the temperature taken by the ambient-temperature measuring means. The ambient temperature measuring means may be exemplified by a thermistor for temperature measurement or the like disposed on a control board. More preferably, an arrangement may be made such that the storage means stores temperature characteristic information on each type of adhesive of the heat-sensitive self-adhesive sheet so that the application conditions may be defined based on the temperature characteristic information retrieved according to the type of heat-sensitive self-adhesive sheet to be used.

This provides an easy development of a desired adhesive force because the application conditions are automatically re-defined according to the change in the ambient temperature.

In accordance with the invention, a printer assembly comprises the above thermal activation device for heat-sensitive self-adhesive sheet and printing means for printing on the heat-sensitive self-adhesive sheet, and is characterized in that the thermal activation device and the printing means are controlled by the same control unit. Thus, the printer assembly can efficiently produce a self-adhesive label which can be readily peeled off while retaining a required adhesive force.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERRED EMBODIMENTS

Preferred embodiments of the invention will hereinbelow be described in detail with reference to the accompanying drawings.

Figure 1:
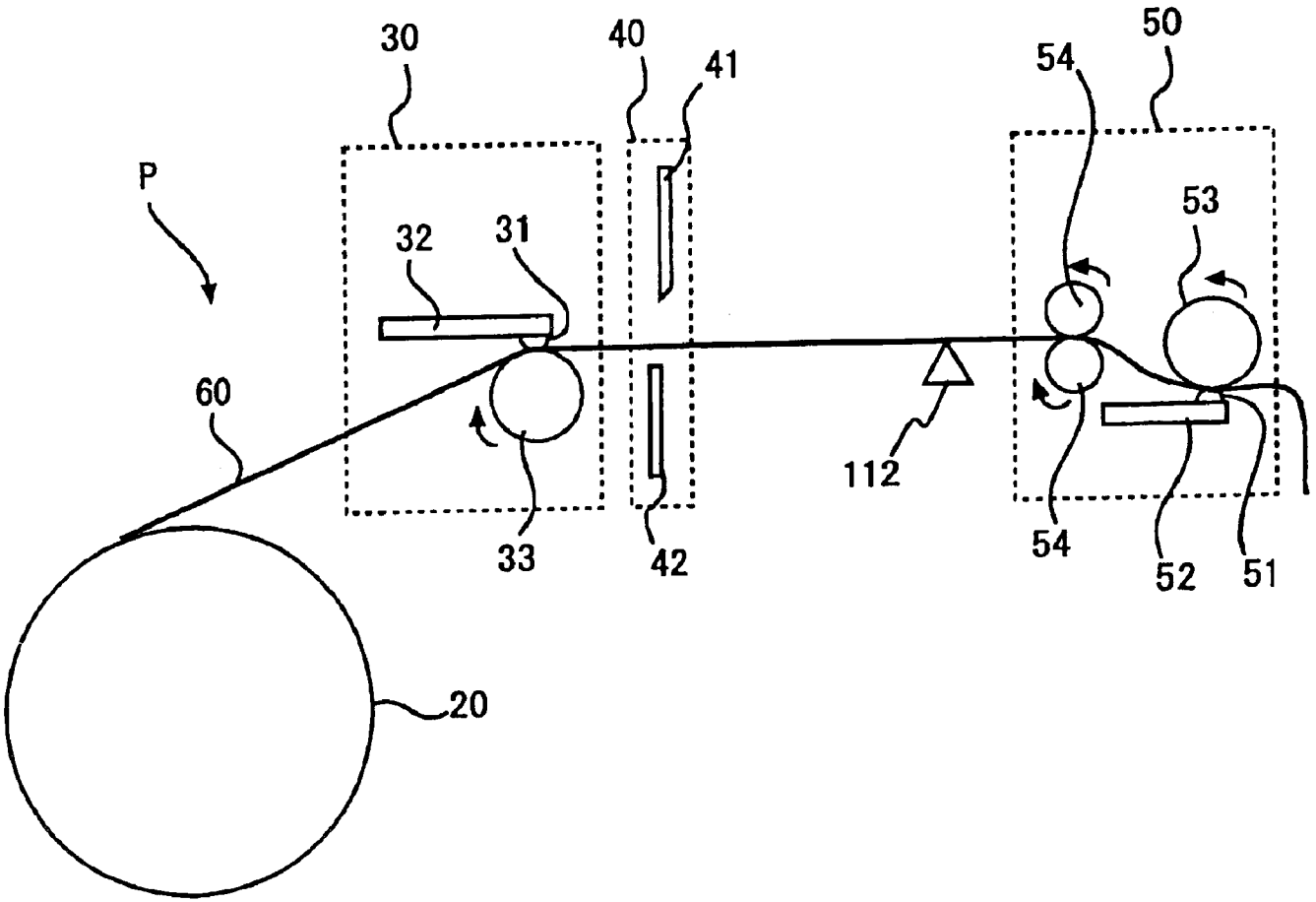
FIG. 1 is a schematic diagram showing an exemplary arrangement of a thermal printer assembly employing a thermal activation device according to the invention.

FIG. 1 is a schematic diagram showing an arrangement of a thermal activation device according to the invention and a thermal printer assembly P employing the same. The thermal printer assembly P includes a roll holder unit 20 for holding a tape-like heat-sensitive self-adhesive label 60 wound into a roll; a printer unit 30 for printing on the heat-sensitive self-adhesive label 60; a cutter unit 40 for cutting the heat-sensitive self-adhesive label 60 in a predetermined length; and a thermal activation unit 50 as the thermal activation device for thermally activating a heat-sensitive adhesive layer of the heat-sensitive self-adhesive label 60.

It is noted here that the heat-sensitive self-adhesive label 60 used in the embodiment is not particularly limited. For instance, the heat-sensitive self-adhesive label may have a construction wherein a label substrate is formed with a heat insulating layer and a heat-sensitive color developing layer (printable face) on a front side thereof, and has the heat-sensitive adhesive layer on a back side thereof, the adhesive layer formed by applying and drying a heat-sensitive adhesive. The heat-sensitive adhesive layer is formed of the heat-sensitive adhesive including a thermoplastic resin, a solid plasticizer and the like as the major components thereof. The heat-sensitive self-adhesive label 60 may be free from the heat insulating layer or provided with a protective layer or colored print layer (previously printed layer) atop the heat-sensitive color developing layer.

The printer unit 30 includes a printing thermal head 32 having a plurality of heat generating elements (resistances) 31 arranged along a width of the heat-sensitive self-adhesive label 60 for performing dot printing; a printing platen roller 33 pressed against the printing thermal head 32; and the like. The thermal head 32 has the same arrangement as a print head of a known thermal printer assembly, the arrangement wherein the plural heat generating elements 31 are laid atop a ceramic substrate whereas the protective layer of crystallized glass is overlaid on the heat generating elements. Therefore, a detailed description of the thermal head is dispensed with.

The printer unit 30 includes an unillustrated drive system which includes, for example, an electric motor, a gear array and the like and drives the printing platen roller 33 into rotation. The drive system rotates the printing platen roller 33 in a predetermined direction thereby unwinding the heat-sensitive self-adhesive label 60 from the roll, and discharges the unwound heat-sensitive self-adhesive label 60 in a predetermined direction as allowing the printing thermal head 32 to print on the label. In FIG. 1, the printing platen roller 33 is rotated clockwise, while the heat-sensitive self-adhesive label 60 is conveyed toward the right-hand side.

The printer unit 30 further includes unillustrated pressure means such as of a helical spring or plate spring. A resilient force of the pressure means acts to bias the printing thermal head 32 against the printing platen roller 33. In this case, a rotational axis of the printing platen roller 33 is maintained in parallel with the array of heat-generating elements 31 whereby the printing thermal head can be pressed against the overall width of the heat-sensitive self-adhesive label 60 at equal pressure.

The cutter unit 40 operates to cut the heat-sensitive self-adhesive label 60, printed by the printer unit 30, in a suitable length. The cutter unit includes a movable blade 41 operated by a drive source (not shown) such as an electric motor, and a fixed blade 42 disposed in opposing relation with the movable blade 41.

A label detection sensor 112 for detecting the presence of the heat-sensitive self-adhesive label 60 is disposed upstream from the thermal activation unit 50.

The thermal activation unit 50 includes a thermally-activating thermal head 52 as heating means having heat generating elements 51; a thermally-activating platen roller 53 as conveyance means for conveying the heat-sensitive self-adhesive label 60; and an insertion roller 54 which is rotated by, for example, an unillustrated drive source, thereby introducing the heat-sensitive self-adhesive label 60 from the printer unit 30 into space between the thermally-activating thermal head 52 and the thermally-activating platen roller 53.

According to the embodiment, the thermally-activating thermal head 52 is constructed the same way as the printing thermal head 32. That is, the thermally-activating thermal head has the same arrangement as the print head of the known thermal printer assembly, wherein the plural heat generating resistances are laid atop the ceramic film and the protective layer of crystallized glass is overlaid on the surfaces of the resistances. Thus, the thermally-activating thermal head 52 and printing thermal head 32 share the same component, thereby achieving cost reduction.

The thermal activation unit 50 includes a drive system which includes, for example, an electric motor and a gear array for rotating the thermally-activating platen roller 53 and the insertion roller 54. The drive system drives the thermally-activating platen roller 53 and insertion roller 54 into rotation for conveying the heat-sensitive self-adhesive label 60 in the predetermined direction (toward the right-hand side).

The thermal activation unit 50 further includes pressure means (such as a helical spring or plate spring) for biasing the thermally-activating thermal head 52 against the thermally-activating platen roller 53. In this case, a rotational axis of the thermally-activating platen roller 53 is maintained in parallel with the array of heat-generating elements 31 so that the thermally-activating thermal head may be pressed against the overall width of the heat-sensitive self-adhesive label 60 at equal pressure.

The platen rollers 33, 53 and the insertion roller 54 disposed in the printer unit 30 and the thermal activation unit 50 are formed from an elastic material such as rubber, plastic, urethane, fluorine resin and silicone resin.

Figure 2:
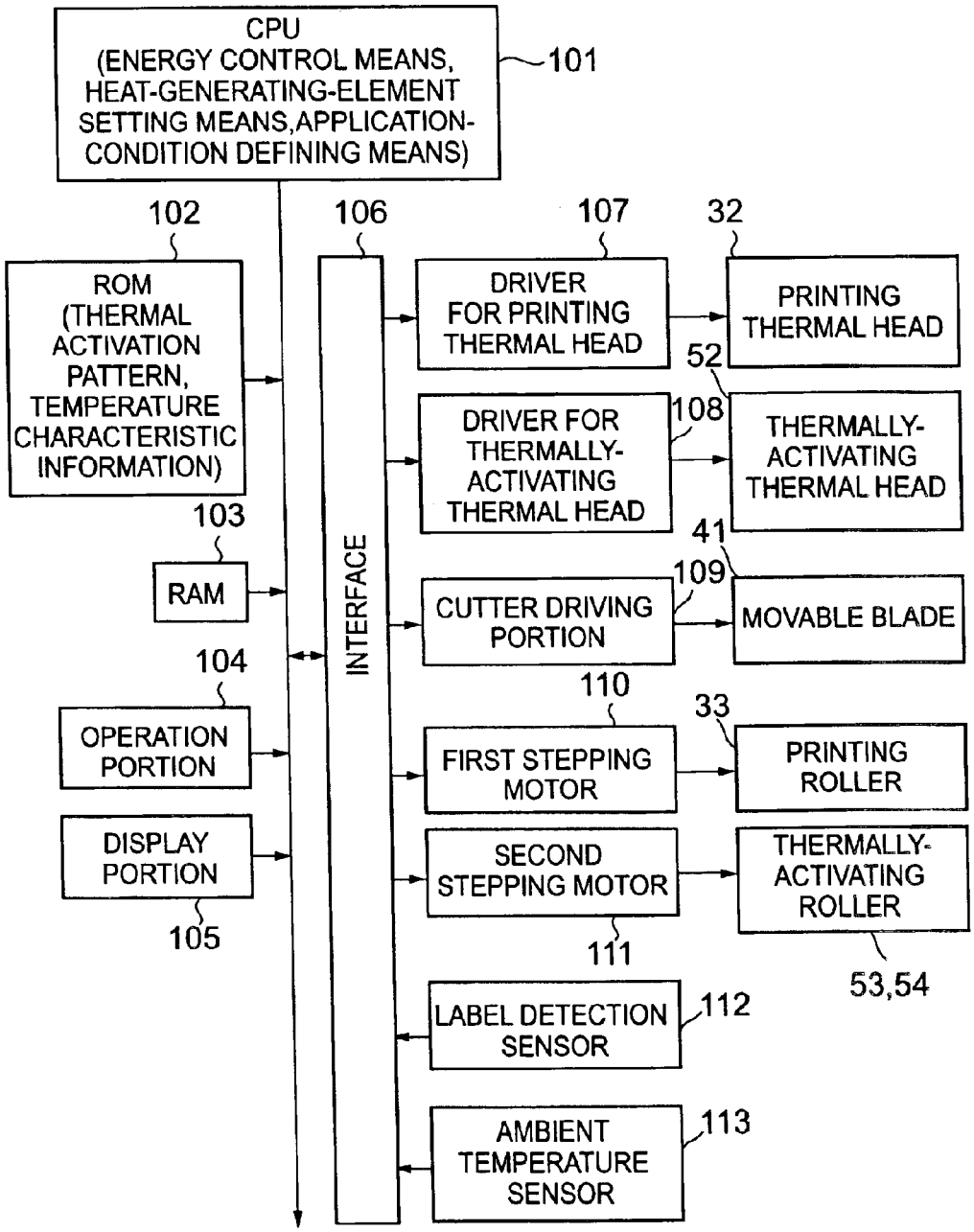
FIG. 2 is a block diagram showing an exemplary arrangement of a control system of a thermal printer assembly P.

FIG. 2 is a control block diagram of the thermal printer assembly P. A control unit of the thermal printer assembly P includes a CPU 101 for governing the control unit and functioning as energy control means; a ROM 102 for storing a control program executed by the CPU 101; a RAM 103 for storing a variety of print formats and the like; an operation portion 104 for inputting, defining or retrieving printing data, print format data and the like; a display portion 105 for displaying the printing data and the like; an interface 106 responsible for data input or output between the control unit and the drive portions; a driver circuit 107 for driving the printing thermal head 32; a driver circuit 108 for driving the thermally-activating thermal head 52; a driver circuit 109 for driving the movable blade 41 for cutting the heat-sensitive self-adhesive label 60; a first stepping motor 110 for driving the printing platen roller 33; a second stepping motor 111 for driving the thermally-activating platen roller 53 and insertion roller 54; the label detection sensor 112 for detecting the presence of the heat-sensitive self-adhesive label 60; and an ambient temperature sensor 113.

The ROM 102 holds information on each type of heat-sensitive adhesive, which includes, for example, a relation between the ambient temperature, applied energy and developed adhesive force; temperature characteristics of each adhesive; and the like. Further, an arrangement may be made such that the ROM 102 also holds information representative of thermal activation patterns based on which the heat-sensitive self-adhesive label 60 is thermally activated, permitting a user to select any one of the registered thermal activation patterns.

Next, referring to FIGS. 1 and 2, description is made on a sequence of printing and thermally activating processes by means of the printer assembly P according to the embodiment. In principle, based on control signals supplied from the CPU 101, a desired printing operation is performed by the printer unit 30, the cutter unit 40 performs a cutting operation at a predetermined timing, the thermal activation unit 50 performing a thermal activation operation with a predetermined energy.

First, the printing platen roller 33 of the printer unit 30 is rotated to unwind the heat-sensitive self-adhesive label 60, which is subjected to the printing thermal head 32 for thermal printing on the printable surface (heat-sensitive color developing layer) thereof. Subsequently, the heat-sensitive self-adhesive label 60 is conveyed to the cutter unit 40 via the rotation of the printing platen roller 33. The heat-sensitive self-adhesive label 60 is further advanced to be introduced into the thermal activation unit 50 by the insertion roller 54 of the thermal activation unit 50 and then, is cut in a predetermined length by the movable blade 41 operated at a predetermined timing.

At this time, the CPU 101 starts energy control for the thermally-activating thermal head 52 in response to a detection signal sent from the label detection sensor 112 disposed upstream from the thermal activation unit 50. On the other hand, the detection signal from the label detection sensor 112 triggers the operation of the second stepping motor 111 in synchronism with the first stepping motor 110, thereby bringing the insertion roller 54 and thermally-activating platen roller 53 into rotation. Thus, the heat-sensitive self-adhesive label 60 is smoothly conveyed into the thermal activation unit 50.

Then, as clamped between the thermally-activating thermal head 52 (heat generating elements 51) and the thermally-activating platen roller 53, the heat-sensitive self-adhesive label 60 has its heat-sensitive adhesive layer heated by the heat generating elements 51 energized at a predetermined timing. The details of the energy control performed at this time will be described below.

Subsequently, the heat-sensitive self-adhesive label 60 is discharged by way of the rotation of the thermally-activating platen roller 53 and thus, the sequence of printing and thermally activating processes is completed.

An arrangement may be made such that when the heat-sensitive self-adhesive label 60 is determined to be discharged from the thermal activation unit 50 based on the detection of a trailing end thereof by the label detection sensor 112, the printing, conveyance and thermal activation of the subsequent heat-sensitive self-adhesive label 60 are started.

FIGS. 3A–3D each show an example of a thermal activation pattern to be implemented by the thermal activation unit 50 of the embodiment. Referring to FIGS. 3A–3D, an area of narrowly spaced hatching represents a portion having the great adhesive force, whereas an area of widely spaced hatching represents a portion having the small adhesive force. When inserted in the thermal activation unit 50, the heat-sensitive self-adhesive label 60 is thermally activated on a per-line basis by the plural heat generating elements 51 arranged in an array along the width of the label.

Figure 3A:
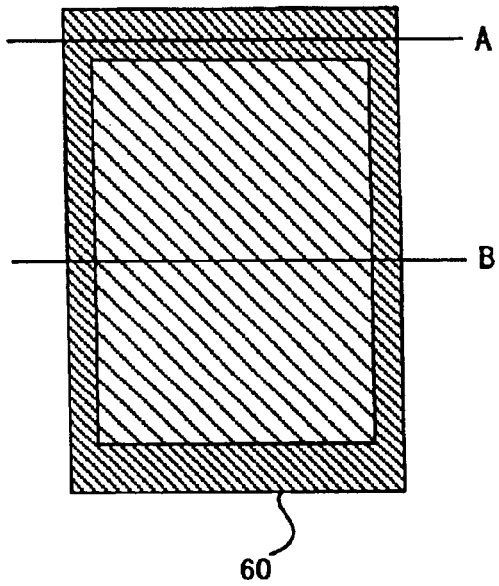
FIGS. 3A–3D are a group of diagrams each showing an example of a thermal activation pattern to be implemented by a thermal activation unit 50 according to the invention.
Figure 3B:
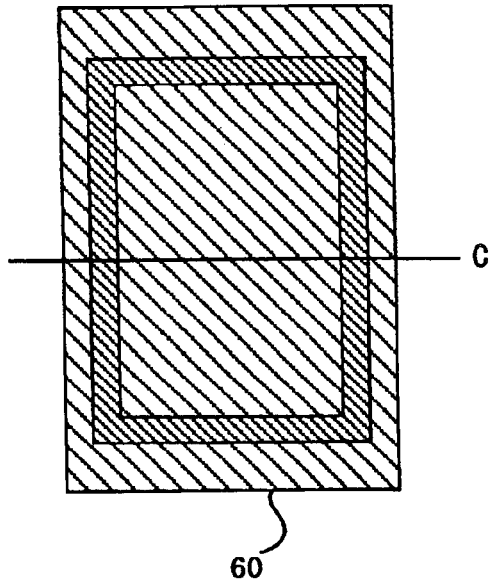

FIG. 3A illustrates a thermal activation pattern for forming a frame-like portion of the great adhesive force on a circumferential edges of the heat-sensitive self-adhesive label 160. FIG. 3B illustrates a pattern for forming a frame-like portion of the great adhesive force a certain distance inwardly from the circumferential edges of the heat-sensitive self-adhesive label 60. According to such thermal activation patterns, the activated heat-sensitive self-adhesive label has at least the small adhesive force on the overall surface thereof and hence, if a part of the label curls up, the curling part will never lead to the separation of the label.

Figure 3C:
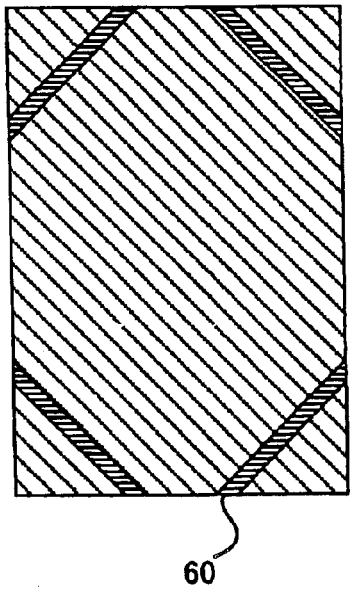

FIG. 3C illustrates a thermal activation pattern for forming portions of the great adhesive force along respective bases of equilateral triangles, respective vertexes of which are defined by four corners of the heat-sensitive self-adhesive label 60. This thermal activation pattern is advantageous in the thermal activation of a peelable label. Since the most part of the sheet has the small adhesive force, the sheet is easy to peel off. However, the sheet locally has the great adhesive force such that the sheet is prevented from being separated before it is realized.

Figure 3D:
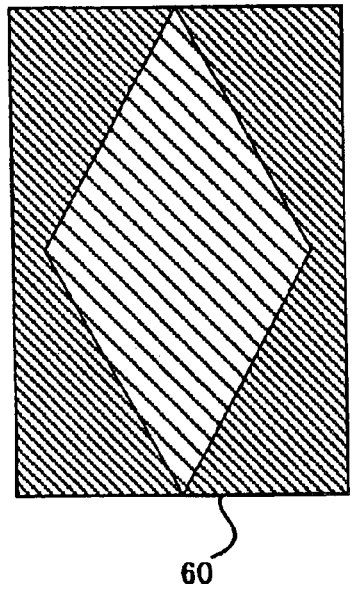

FIG. 3D illustrates a thermal activation pattern for forming a lozenge-shaped portion of the small adhesive force centrally of the heat-sensitive self-adhesive label 60 and a portion of the great adhesive force around the lozenge-shaped portion. According to this thermal activation pattern, the energy required for the thermal activation can be reduced without trading off the adhesive force of the sheet as a whole and hence, power savings can be accomplished.

Figure 4A:
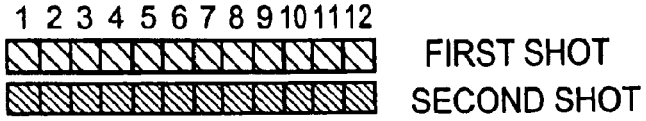
FIGS. 4A–4C are a group of diagrams showing patterns of energizing heat generating elements for thermally activating respective portions of the thermal activation patterns shown in FIGS. 3A and 3B.
Figure 4B:
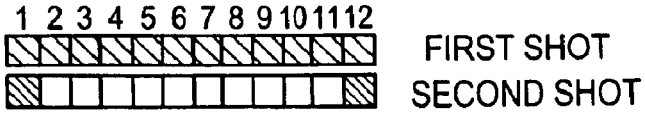
Figure 4C:
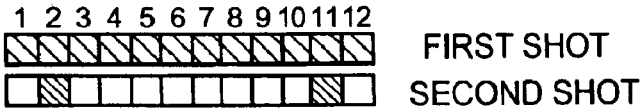

FIGS. 4A–4C illustrate an example of an energization pattern for the heat generating elements which is defined for thermally activating each of linear portions A, B and C extended along the width of the heat-sensitive self-adhesive label 60 shown in FIGS. 3A and 3B. For simplicity, the embodiment uses 12 heat generating elements for widthwise thermal activation of the heat-sensitive self-adhesive label 60. Specifically, the width of the heat-sensitive self-adhesive label 60 is divided into 12 dot regions, each of which is thermally activated by each of the heat generating elements.

In FIGS. 4A–4C, a portion of widely spaced hatching represents a dot applied with a first voltage pulse, whereas a portion of narrowly spaced hatching represents a dot applied with a second voltage pulse. The first voltage pulse is set at such a pulse voltage and pulse width as to develop the small adhesive force in one shot. The second voltage pulse is set at such a pulse voltage and a pulse width as to permit one shot to develop the strong adhesive force from the dot region subjected to the first voltage pulse.

Specifically, provided that an energy applied by the first voltage pulse is represented by E1 and that applied by the second voltage pulse is represented by E2, an energy to develop the small adhesive force on the heat-sensitive self-adhesive label is equal to E1, whereas an energy to develop the great adhesive force is equal to E1+E2.

FIG. 4A shows a pattern defined for thermally activating the linear portion A shown in FIG. 3A. Where the linear portion A of FIG. 3A is to be thermally activated, the first shot is defined to energize all the 12 heat generating elements which are applied with the first voltage pulse thereby developing the small adhesive force from all the dot regions, and then the second shot applies the second voltage pulse to all the heat generating elements so as to develop the great adhesive force from all the dot regions.

FIG. 4B shows a pattern defined for thermally activating the linear portion B of FIG. 3A. Specifically, the first shot is defined to energize all the 12 heat generating elements which are applied with the first voltage pulse thereby developing the small adhesive force from all the dot regions, and then the second shot is defined to energize the first and twelfth heat generating elements on the opposite ends which are applied with the second voltage pulse thereby developing the great adhesive force from the dot regions corresponding to the energized heat generating elements.

FIG. 4C shows a pattern defined for thermally activating the linear portion C of FIG. 3B. Specifically, the first shot is defined to energize all the 12 heat generating elements which are applied with the first voltage pulse thereby developing the small adhesive force from all the dot regions, and then the second shot is defined to energize the second and eleventh heat generating elements which are applied with the second voltage pulse thereby developing the great adhesive force from the dot regions corresponding to the energized heat generating elements.

In this manner, the heat generating element corresponding to the region to develop the small adhesive force may be only applied with the first voltage pulse for energization, whereas the heat generating element corresponding to the region to develop the great adhesive force may be applied with the first and second voltage pulses for energization. In FIG. 4, the adhesive forces may naturally be developed in the same pattern by reversing the energization definitions for the first shot and the second shot. Further, the first voltage pulse and the second voltage pulse may have the same voltage and width.

Figure 5A:
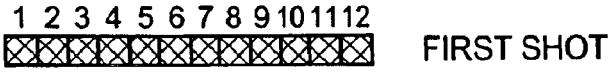
FIGS. 5A–5C are a group of diagrams showing other patterns of energizing the heat generating elements for thermally activating the respective portions of the thermal activation patterns shown in FIGS. 3A and 3B.
Figure 5B:
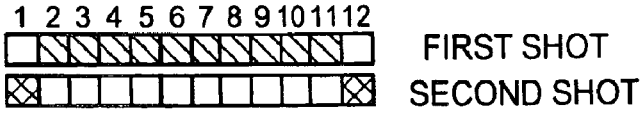
Figure 5C:
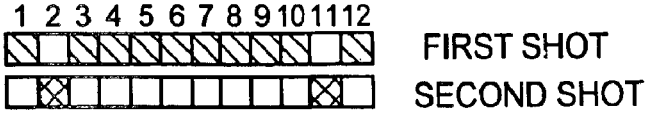

FIGS. 5A–5C each illustrate another example of the energization pattern for the heat generating elements which is defined for thermally activating each of the linear portions A, B and C extended along the width of the heat-sensitive self-adhesive label 60 shown in FIGS. 3A and 3B. In FIGS. 5A–5C, a portion of single hatching represents a dot applied with a third voltage pulse, whereas a double-hatched portion represents a dot applied with a fourth voltage pulse. The third voltage pulse is set at such a pulse voltage and pulse width as to develop the small adhesive force in one shot. The fourth voltage pulse is set at such a pulse voltage and a pulse width as to develop the great adhesive force in one shot.

Specifically, provided that an energy applied by the third voltage pulse is represented by E3 and that applied by the fourth voltage pulse is represented by E4, an energy to develop the small adhesive force on the heat-sensitive self-adhesive label is equal to E3, whereas an energy to develop the great adhesive force is equal to E4. Relations between these energies and the energies shown in FIG. 4 are E1=E3, E1+E2=E4.

FIG. 5A shows a pattern defined for thermally activating the linear portion A of FIG. 3A. The pattern is defined to energize all the 12 heat generating elements which are applied with one shot of the fourth voltage pulse thereby developing the great adhesive force from all the dot regions to be thermally activated in one shot.

FIG. 5B shows a pattern defined for thermally activating the linear portion B of FIG. 3A. The first shot is defined to energize the second to the eleventh heat generating elements which are applied with the third voltage pulse thereby developing the small adhesive force from the corresponding dot regions, and then the second shot is defined to energize the first and twelfth heat generating elements on the opposite ends which are applied with the fourth voltage pulse thereby developing the great adhesive force from the corresponding dot regions.

FIG. 5C shows a pattern defined for thermally activating the linear portion C of FIG. 3B. The first shot is defined to energize the first, third to tenth, and twelfth heat generating elements which are applied with the third voltage pulse thereby developing the small adhesive force from the dot regions corresponding to these heat generating elements, and then the second shot is defined to energize the second and eleventh heat generating elements which are applied with the fourth voltage pulse thereby developing the great adhesive force from the dot regions corresponding to these heat generating elements.

The method for developing the adhesive force in a desired pattern is not limited to the foregoing and various other patterns may be contemplated. However, such a pattern should be decided taking the thermal-activation process time, power consumption and ease of control into consideration.

Thus, the thermal activation unit 50 as the thermal activation device is adapted for thermal activation in various patterns because of the free selection of the heat generating element to be energized. In addition, the thermal activation unit performs the thermal activation in a manner to apply two or more shots of voltage pulses to the region to be thermally activated in one shot, thus producing a mixed state where the portion having the great adhesive force and the portion having the small adhesive force exist. Furthermore, the thermal activation unit may perform the thermal activation under more precise control for developing the adhesive forces in gradations (progressively varied adhesive forces).

Figure 6:
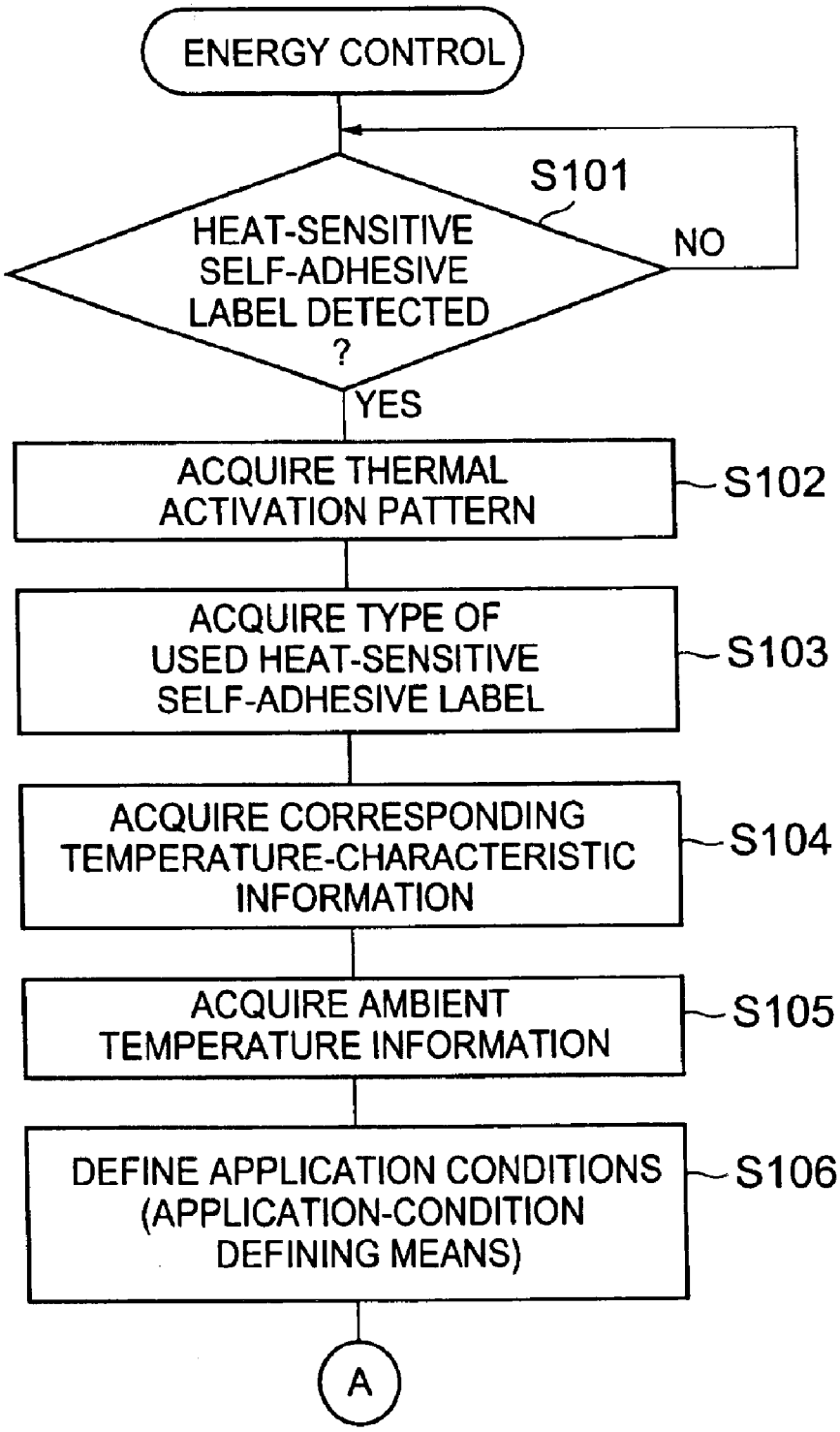
FIG. 6 is a flow chart representing steps of energy control process executed by a CPU 101 as energy control means.
Figure 7:
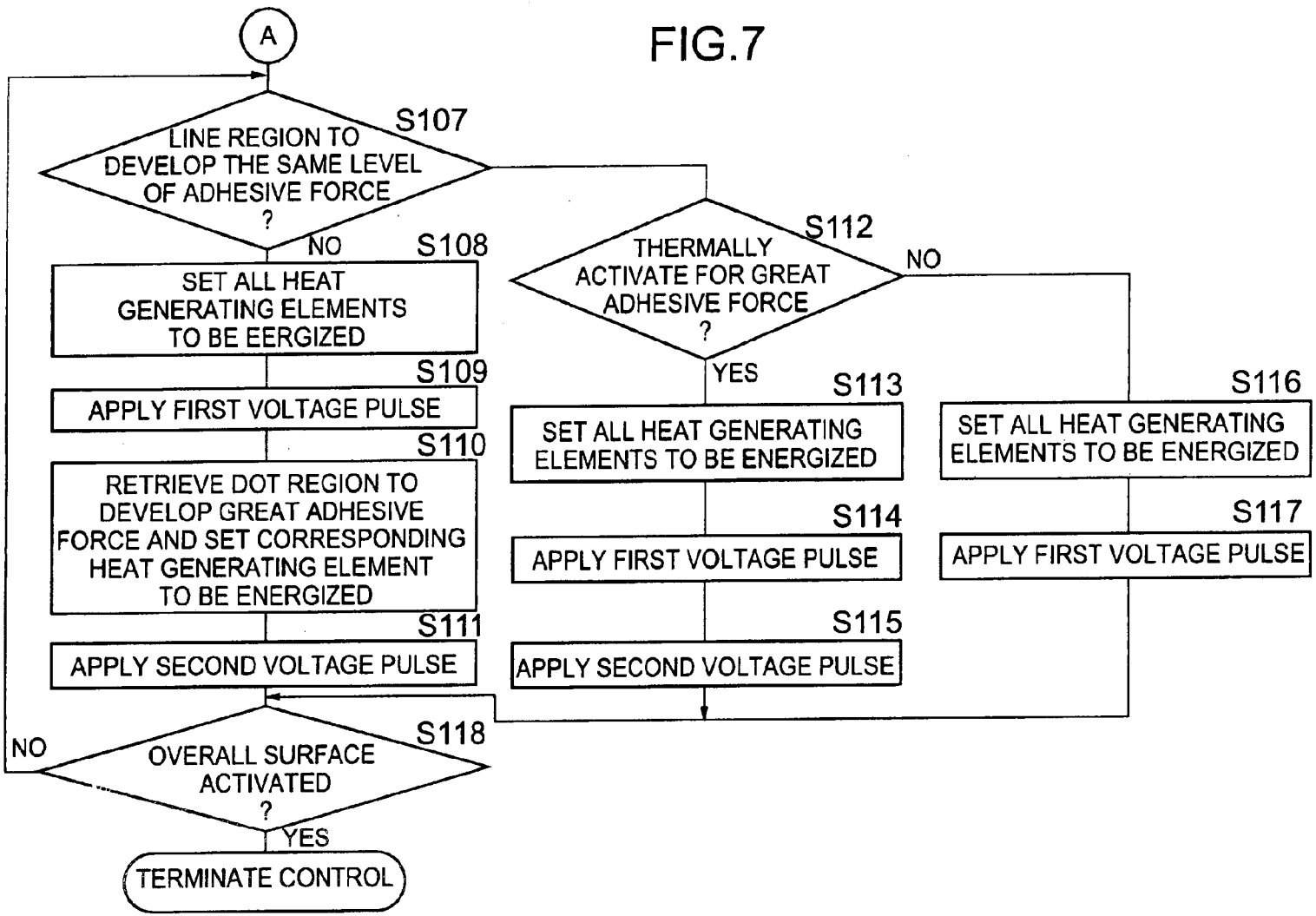
FIG. 7 is a flow chart representing steps of the energy control process executed by the CPU 101 as the energy control means.

Next, referring to FIGS. 6 and 7, description is made on energy control process executed by the Cpu 101 as the energy control means. This embodiment illustrates a case where the heat-sensitive self-adhesive label 60 is thermally activated through application of the first voltage pulse (Energy E1) and the second voltage pulse (Energy E2), as shown in FIGS. 4A–4C.

Firstly in Step S101, whether the heat-sensitive self-adhesive label 60 is present or not is determined based on the detection signal from the label detection sensor 112. When the heat-sensitive self-adhesive label 60 is determined to be absent, the operation of Step S101 is repeated until the detection signal is sent from the label detection sensor 112.

When the heat-sensitive self-adhesive label 60 is determined to be present in Step S101, the control flow proceeds to Step S102 to acquire a thermal activation pattern, followed by Step S103 where a type of used heat-sensitive self-adhesive label is acquired. It is noted here that the thermal activation patterns and the types of heat-sensitive self-adhesive labels are previously set via the input from operation portion 104 by the user and stored in the RAM 103.

In the subsequent Step S104, information representative of temperature characteristics of the acquired heat-sensitive self-adhesive label 60 is acquired. For instance, in a case where the information corresponding to the acquired heat-sensitive self-adhesive label 60 is stored in the ROM 102, the information is retrieved from the ROM 102, whereas default temperature-characteristic information (information related to thermal activation) is taken in a case where such information is not stored in the ROM 102. Information usable as the default temperature-characteristic information may include, for example, relation between ambient temperatures for an adhesive based on an acrylic resin, applied energy and developed adhesive force, carbonization temperature of the acrylic resin and the like.

Next in Step S105, information representative of an actual ambient temperature is acquired from the ambient temperature sensor 113. Then, an optimum energy to be applied is decided based on the acquired ambient temperature information and the temperature characteristic information of the adhesive acquired in Step S104, and conditions for applying the optimum energy are defined (Step S106). For example, application-condition defining means may define the number of application times, the magnitude of pulse voltage, and the pulse width. The application conditions may be defined per region (one line) of the heat-sensitive self-adhesive label 60 that is thermally activated in one step.

Subsequently, the control flow proceeds to a reference sign A in FIG. 7 to set a heat generating element(s) to be energized for performing the thermal activation by applying the voltage pulse. In Step S107, determination is made as to whether the line is to develop the same level of adhesive force (the great or small adhesive force) or not.

When it is determined that the line is to develop different levels of adhesive forces, the control flow proceeds to Step S108 where all the heat generating elements are set to be energized and then are applied with the first voltage pulse for thermal activation (Step S109). Then, a dot region to develop the great adhesive force is read in from the thermal activation pattern acquired in Step S102 so as to set the corresponding heat generating elements to be energized. The second voltage pulse is applied to the set heat generating elements for thermal activation (Step S111).

When it is determined that the line is to develop the same level of adhesive force, the control flow proceeds to step S112 to determine whether the whole one line is to develop the great adhesive force or not. When it is determined that the great adhesive force is to be developed, the control flow proceeds to Step S113 where all the heat generating elements are set to be energized and then applied with the first voltage pulse for thermal activation (Step S114), followed by the second voltage pulse for thermal activation (Step S115).

When it is determined in Step S112 that the whole line is not to develop the great adhesive force (develop the small adhesive force), the control flow proceeds to Step S116 where all the heat generating elements are set to be energized and then applied with the first voltage pulse for thermal activation (Step S117).

After completion of the thermal activation of the one line, determination is made in Step S118 as to whether the overall surface of the heat-sensitive self-adhesive label 60 is thermally activated or not. When it is determined that the thermal activation is completed, the energy control process is terminated. When it is determined that the thermal activation is not completed, the control flow proceeds to Step S107 to start the thermal activation of the subsequent line region. At each completion of the thermal activation of line, the conveyance means of the thermal activation device performs the operation for conveying the heat-sensitive self-adhesive label.

Thus, the energy control according to the embodiment always ensures the optimum energy applied to the heat-sensitive self-adhesive label 60 so that a desired level of adhesive force can be developed. In addition the embodiment provides specific definitions of the application conditions (magnitude of voltage pulse, pulse width and the like) and of the heat generating elements to be energized, thus permitting the thermal activation process to be conducted based on any of the various patterns. The application conditions and the energization of the heat generating element (s) may be defined at each per-line thermal activation process or may be re-defined by acquiring the ambient temperature information at each per-line thermal activation.

Next, description is made on energy control process for thermally activating the heat-sensitive self-adhesive label 60 by way of application of the third voltage pulse (Energy E3) and the fourth voltage pulse (Energy E4), as shown in FIG. 5. This energy control process differs from the energy control process illustrated in FIGS. 6 and 7 in correspondence to FIG. 4 only in the processings for setting the heat generating elements and applying the voltage pulses. That is, the control flow to the definition of application conditions (Steps S101 to S106 in FIG. 6) are the same as the above and hence, the description thereof is dispensed with.

Figure 8:
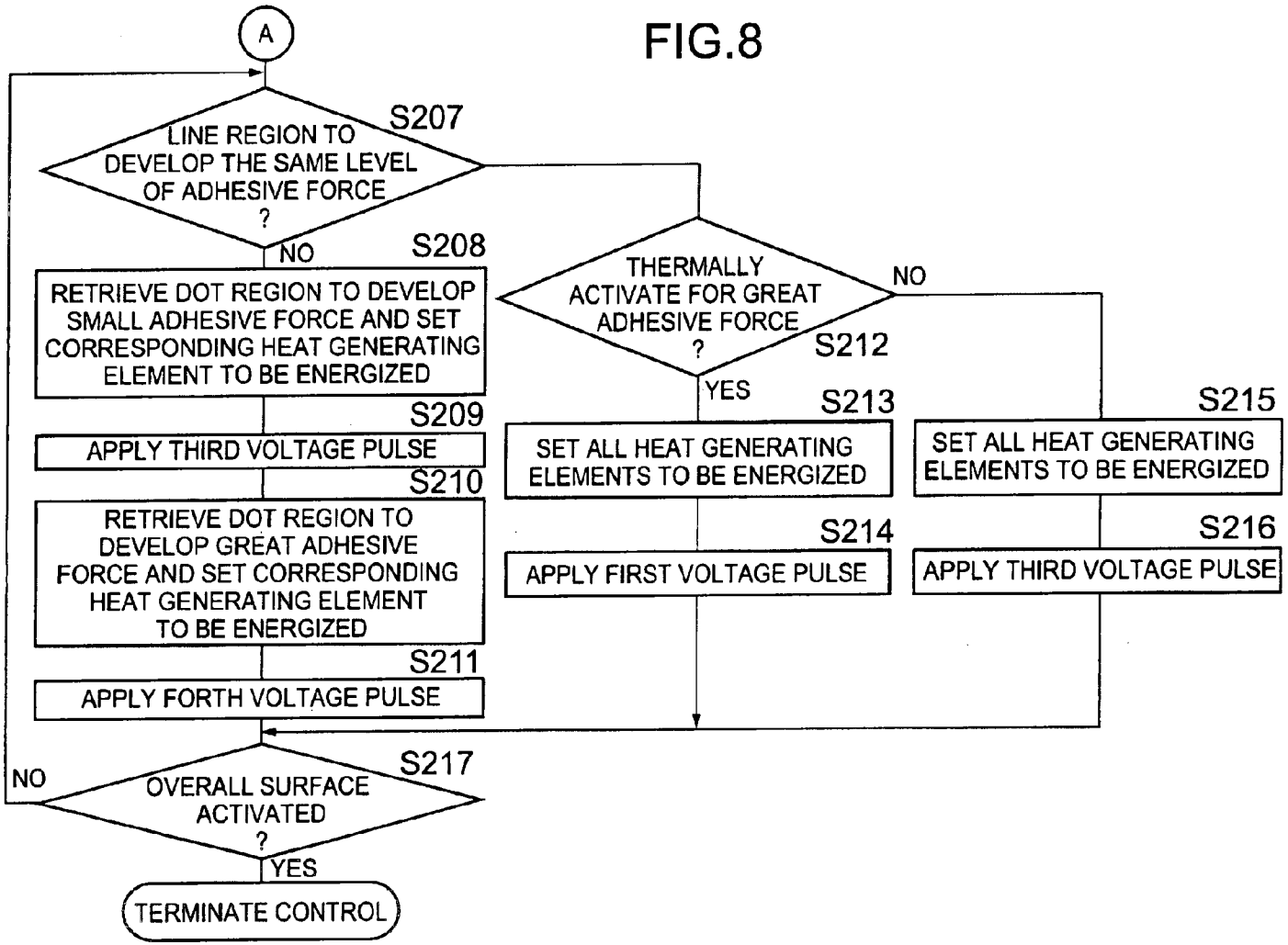
FIG. 8 is a flowchart representing steps of another energy control process executed by the CPU 101 as the energy control means.
Figure 9:
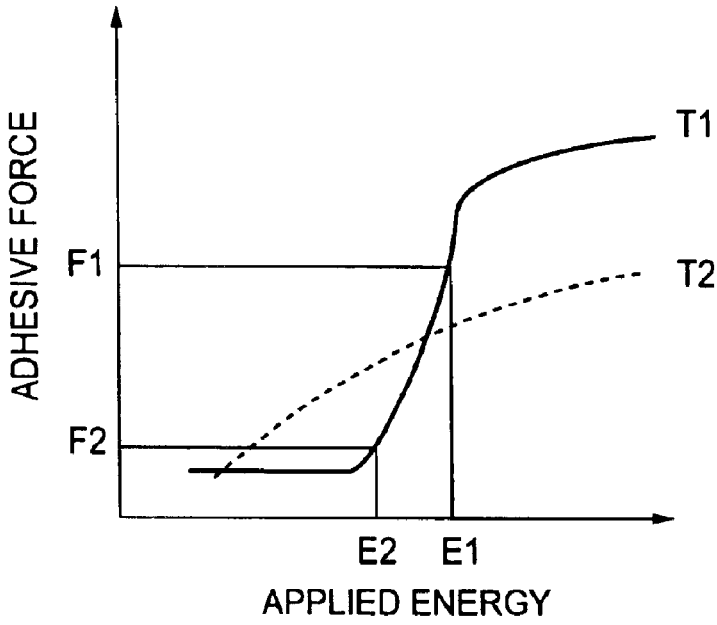
FIG. 9 is a graph representing a relation between an adhesive force of an adhesive of a heat-sensitive self-adhesive label and an applied energy, and an ambient temperature characteristic curve.

FIG. 8 is a flow chart illustrating a part of the energy control flow corresponding to FIGS. 5A–5C, representing steps following the sign A in FIG. 6.

Firstly in Step S207, determination is made as to whether a line region is to develop the same level of adhesive force or not (the great or small adhesive force).

When it is determined that the line region is to develop different levels of adhesive forces, the control flow proceeds to Step S208 to read in dot regions to develop the small adhesive force from the thermal activation pattern acquired in Step S102 whereas the corresponding heat generating elements are set to be energized so as to be applied with the third voltage pulse for thermal activation (Step S209). Then, dot regions to develop the great adhesive force are read in from the thermal activation pattern acquired in Step S102 so as to set the corresponding heat generating elements (other heat generating elements than the ones having been set in Step S208) to be energized (Step S210). The fourth voltage pulse is applied to the corresponding heat generating elements for thermal activation (Step S211).

When, on the other hand, it is determined that the line region is to develop the same level of adhesive force, the control flow proceeds to step S212 to determine whether the whole one line is to develop the great adhesive force or not.

When it is determined that the great adhesive force is to be developed, the control flow proceeds to Step S213 where all the heat generating elements are set to be energized and then applied with the fourth voltage pulse for thermal activation (Step S214).

Where it is determined in Step S212 that the whole line region is not to develop the great adhesive force (develop the small adhesive force), the control flow proceeds to Step S215 where all the heat generating elements are set to be energized and then applied with the third voltage pulse for thermal activation (Step S216).

After completion of the thermal activation of the one line, the control flow proceeds to Step S217 to determine whether the overall surface of the heat-sensitive self-adhesive label 60 is thermally activated or not. When it is determined that the thermal activation is completed, the energy control process is terminated. When it is determined that the thermal activation is not completed, the control flow proceeds to Step S207 to start the thermal activation of the subsequent line region.

Although the invention accomplished by the inventors has been specifically described with reference to the embodiments thereof, it is to be understood that the invention is not limited to the foregoing embodiments but various changes and modifications may be made thereto within the scope of the invention.

For instance, the thermal activation device according to the invention is adapted for the thermal activation processes based on various patterns other than those shown in FIGS. 3A–3D. There may be contemplated a pattern, for example, wherein a dot region having the great adhesive force and a dot region having the small adhesive force alternate each other, or wherein a portion having the great adhesive force and a portion having the small adhesive force are formed in concentric circular shapes or concentric frame shapes alternating each other.

The foregoing embodiments take the procedure including the steps of: acquiring the information representative of the actual ambient temperature from the ambient temperature sensor 113; deciding the optimum energy to be applied based on the acquired ambient temperature information and the temperature characteristic information on the adhesive in the used heat-sensitive self-adhesive label 60; and defining the conditions for applying the optimum energy. However, there may be a case where the ambient temperature is not equal to that of the support material. In a case where the support material is a frozen product, for example, the support material has a temperature of 0° C. or lower. In a case where the support material is a heated product, the support material has high temperatures. This leads to a significant difference from the temperature taken by the ambient temperature sensor 113 (the temperature of the environment where the thermal activation device is installed, normally room temperatures). In this case, it is preferred that the temperature of the support material is previously manually entered via the operation portion 104, so as to be used as the ambient temperature based on which the optimum energy is decided for defining the application conditions.

In another approach, bar codes may be affixed to the front side (or back side) of the heat-sensitive self-adhesive label 60, the bar codes including information indicative of the type of the heat-sensitive adhesive, the level of energy required for thermally activating the heat-sensitive adhesive and the like. A bar-code reading sensor (bar code reader) may be provided for reading the bar codes affixed to the heat-sensitive self-adhesive label 60, thereby acquiring the temperature characteristic information on the adhesive (Steps S104 to 106 in FIG. 6).

The foregoing embodiments illustrate the cases, as an example, where the invention is applied to the printer assembly of thermal printing system, such as a thermal printer. However, the invention is also applicable to printer assemblies of heat transfer system, ink-jet printing system and laser printing system. In such cases, labels with their printable surfaces suitably processed for the respective printing systems are used in place of the label having the printable surface of the thermal print layer.

According to the invention, the thermal activation device at least comprises the thermal head which serves as the thermally-activating heating means for thermally activating the heat-sensitive adhesive layer of the heat-sensitive self-adhesive sheet including a sheet-like substrate having the printable surface on one side thereof and the heat-sensitive adhesive layer on the other side thereof and which includes the array of heat generating elements individually controllably energized; and the energy control means for applying one or more shots of voltage pulse to the plural heat generating elements for energization thereby thermally activating the area of the heat-sensitive self-adhesive sheet that can be thermally activated by the thermal head in one step, and is characterized in that in a case where plural shots of voltage pulses are applied to the heat generating elements of the thermal head for thermally activating the heat-sensitive self-adhesive sheet, the energy control means can selectively change the heat generating element(s) to be energized by the voltage pulse each time the voltage pulse is applied. Therefore, the thermal activation device can not only control the degree of adhesive force to be developed but also carry out the thermal activation process in a manner to develop the adhesive forces in any of various patterns. This provides an ability to develop different degrees of adhesive forces from adjoining dot regions. The ability constitutes an advantage that the adhesive force or adhesive pattern of the sheet can be freely controlled according to the use of the sheet.

What is claimed is:

1. A thermal activation device for a heat-sensitive self-adhesive sheet, the thermal activation device comprising: thermally-activating heating means including a thermal head having an array of individually and controllably energized heat generating elements for thermally activating a heat-sensitive adhesive layer of a heat-sensitive self-adhesive sheet comprised of a sheet-like substrate having a printable surface on a first side thereof and the heat-sensitive adhesive layer on a second side thereof; and energy control means for controlling the thermally-activating heating means by applying one or more voltage pulses to the heat generating elements of the thermal head for energizing the heat generating elements to thereby thermally activate an area of the heat-sensitive self-adhesive layer of the heat-sensitive self-adhesive sheet in one step; wherein when a plurality of the voltage pulses are applied to the heat generating elements by the energy control means to thermally activate the area of the heat-sensitive self-adhesive layer, the energy control means selectively switches between the heat generating elements to be energized by the voltage pulses each time one of the voltage pulses is applied.

2. A thermal activation device for a heat-sensitive self-adhesive sheet according to claim 1; wherein the energy control means includes means for selecting any of dot regions of the area of the heat-sensitive self-adhesive layer and for applying thereto either a first energy or a second energy higher than the first energy.

3. A thermal activation device for a heat-sensitive self-adhesive sheet according to claim 1; wherein the energy control means comprises defining means for defining application conditions corresponding to at least one of a magnitude, width, and number of application times of the voltage pulse to be applied, and selecting means for selecting the heat generating element or elements to be energized each time the voltage pulse is applied.

4. A thermal activation device for a heat-sensitive self-adhesive sheet according to claim 3; further comprising storage means for storing information corresponding to a thermal activation pattern for thermally activating the heat-sensitive self-adhesive layer of the heat-sensitive self-adhesive sheet; wherein the defining means and the selecting means respectively defines the application conditions and selects the heat generating element or elements to be energized in accordance with the thermal activation pattern stored in the storage means.

5. A thermal activation device for a heat-sensitive self-adhesive sheet according to claim 3; further comprising measuring means for measuring an ambient temperature in the vicinity of the area where the heat-sensitive self-adhesive sheet is thermally activated by the thermally-activating heating means; and wherein the defining means defines the application conditions in accordance the temperature measured by the temperature measuring means.

6. A printer assembly comprising: a thermal activation device for a heat-sensitive self-adhesive sheet according to claim 1; printing means for printing on the printable surface of the heat-sensitive self-adhesive sheet; and a single control unit for controlling operation of each of the thermal activation device and the printing means.

7. A thermal activation device comprising:

a thermal head having a plurality of heat generating elements for thermally activating a heat-sensitive adhesive layer of a heat-sensitive self-adhesive sheet having a printable first surface and a second surface containing the heat-sensitive adhesive layer; and energy control means for controlling energization of the heat generating elements of the thermal head by applying one or more voltage pulses to the heat generating elements to thereby thermally activate a preselected area of the heat-sensitive self-adhesive layer of the heat-sensitive self-adhesive sheet in a single step.

8. A thermal activation device according to claim 7; wherein the heat-sensitive adhesive layer of the heat-sensitive self-adhesive sheet is formed of a heat-sensitive adhesive comprised of a thermoplastic resin.

9. A thermal activation device according to claim 7; wherein the energy control means comprises defining means for defining application conditions corresponding to at least one of a Magnitude, width, and number of application times of the voltage pulse to be applied, and selecting means for selecting the heat generating element to be energized each time the voltage pulse is applied by the energy control means.

10. A thermal activation device according to claim 9; further comprising storage means for storing information corresponding to a thermal activation pattern for thermally activating the heat-sensitive self-adhesive layer of the heat-sensitive self-adhesive sheet; wherein the defining means and the selecting means respectively defines the application conditions and selects the heat generating element to be energized in accordance with the thermal activation pattern stored in the storage means.

11. A thermal activation device according to claim 9; further comprising measuring means for measuring an ambient temperature in the vicinity of the preselected area where the heat-sensitive self-adhesive sheet is thermally activated; and wherein the defining means defines the application conditions in accordance the temperature measured by the measuring means.

12. A printer assembly comprising: a thermal activation device according to claim 7; and a printer unit for printing on the printable surface of the heat-sensitive self-adhesive sheet.

13. A printer assembly according to claim 12; wherein the thermal activation device further comprises a thermally activating platen roller disposed opposite to and confronting the heat generating elements of the thermal head, and an insertion roller for conveying the heat-sensitive self-adhesive sheet from the printing unit to the thermal activation device and for introducing the heat-sensitive self-adhesive sheet between the thermally activating platen roller and the heat generating elements of the thermal head.

14. A printer assembly according to claim 12; further comprising a single control unit for controlling operation of each of the thermal activation device and the printing means.

15. A printer assembly according to claim 12; wherein the printing unit has a thermal head identical in construction as the thermal head of the thermal activation device.

16. A thermal activation device comprising:

a thermal head having a plurality of heat generating elements for thermally activating a heat-sensitive adhesive layer of a heat-sensitive self-adhesive sheet having a printable first surface and a second surface containing the heat-sensitive adhesive layer; and energy control means for controlling energization of the heat generating elements of the thermal head by applying a plurality of voltage pulses to the heat generating elements while selectively switching between the heat generating elements to be energized by the voltage pulses each time one of the voltage pulses is applied to thereby thermally activate a preselected area of the heat-sensitive self-adhesive layer of the heat-sensitive self-adhesive sheet.

17. A thermal activation device according to claim 16; wherein the energy control means comprises defining means for defining application conditions corresponding to at least one of a magnitude, width, and number of application times of the voltage pulse to be applied, and selecting means for selecting the heat generating element to be energized each time the voltage pulse is applied by the energy control means.

18. A thermal activation device according to claim 17; further comprising storage means for storing information corresponding to a thermal activation pattern for thermally activating the heat-sensitive self-adhesive layer of the heat-sensitive self-adhesive sheet; wherein the defining means and the selecting means respectively defines the application conditions and selects the heat generating element to be energized in accordance with the thermal activation pattern stored in the storage means.

19. A thermal activation device according to claim 17; further comprising measuring means for measuring an ambient temperature in the vicinity of the preselected area where the heat-sensitive self-adhesive sheet is thermally activated; and wherein the defining means defines the application conditions in accordance the temperature measured by the measuring means.

20. A printer assembly comprising: a thermal activation device according to claim 16; and a printer unit for printing on the printable surface of the heat-sensitive self-adhesive sheet.

* * * * *